United States Patent [19]

Koebner

[11] 4,019,921

[45] Apr. 26, 1977

[54] CHEMICAL CONDENSATION PRODUCTS, THEIR PREPARATION AND USE

[76] Inventor: Adolf Koebner, The Retreat, St. Bees, Cumbria, CA27 OBY, England

[22] Filed: Feb. 11, 1975

[21] Appl. No.: 549,083

[30] Foreign Application Priority Data

Feb. 18, 1974 United Kingdom ..... 7209/74

[52] U.S. Cl. ..... 106/238; 162/173; 162/179; 162/180; 260/97.5

[51] Int. Cl.[2] ..... C08J 3/02

[58] Field of Search ..... 260/97.5, 97.6, 101, 260/106; 162/173, 179, 180

[56] References Cited

UNITED STATES PATENTS 2,394,615 2/1946 Jenkins ..... 260/97.6

3,390,046 6/1968 McDavid ..... 260/101

FOREIGN PATENTS OR APPLICATIONS 1,219,885 1/1971 United Kingdom

*Primary Examiner*—Donald E. Czaja
*Assistant Examiner*—William E. Parker
*Attorney, Agent, or Firm*—Young & Thompson

[57] ABSTRACT

Condensation products are formed from the unsaponifiable constituents of tall oil and alpha- beta- unsaturated mono- or poly-basic aliphatic acids or their derivatives. The condensation products can be formed into aqueous soap solutions in which form they find use as agents in the sizing of paper, particularly when used as fortifying agents for rosin acid soap sizes.

6 Claims, No Drawings

CHEMICAL CONDENSATION PRODUCTS, THEIR PREPARATION AND USE

This invention relates to novel chemical condensation products, their preparation and to their use as agents for the sizing of paper. The novel products are derived from the unsaponifiable constituents of tall oil.

Crude tall oil is a commerical by-product from the Kraft paper industry. It contains fatty and rosin acids and variable amounts of unsaponifiable constituents.

The separation and purification of the fatty acids and rosin acids is carried out commercially and tall oil is a valuable source of these acids. However, their separation, especially from the unsaponifiable matter, is difficult since the unsaponifiable constituents co-distil to a large extent with the fatty acids in the initial fractions. As a consequence it has been usual to burn these initial fractions as a fuel, particularly as the unsaponifiable matter would apparently have no useful value as a raw material, even if it were separated. Thus, while tall oil is purified on a commercial scale to obtain fatty acids and rosin acids therefrom, the unsaponifiable constituents have hitherto been regarded as an undesirable by-product of no commerical value.

In my previous patent (U.S. Pat. No. 3,654,255) I have described an improved process for the removal of unsaponifiable components from tall oil, or from distillation fractions thereof, as a preliminary to a more efficient separation of the desired rosin and fatty acid components. However, though the unsaponifiable material could now be obtained in a purer state, it still had no utility as a raw material.

The nature of the components in the unsaponifiable fraction of tall oil is to a large extent unknown. It is certainly a very complex mixture containing many varied unsaturated hydrocarbons as well as some unsaturated ketonic and aldehydic components. Among those reported to have been identified are alpha- and beta-pinenes, camphene, carene and terpineol in a low boiling fraction (boiling range 60° – 145°/10mm) which accounts for 13% of the total, while the remainder (boiling range 98° – 152° C/0.5mm), except for a high boiling residue of about 15%, contained mainly alicyclic unsaturated hydrocarbons, possibly derived by decarboxylation of rosin acids, with some sesquiterpenes of the cadanine type and diterpenes which possibly had the pinanthrene and retene structures. Individual compounds thought to be present, though not positively identified, include pinardiene, palustradiene, dehydroabietene and abietadiene. As oxygen-containing compounds, iso-d-pimeral, phellandral, palustrinal and iso-pimeral have been identified.

I have now discovered that the unsaponifiable matter from tall oil can be reacted with alpha- beta-unsaturated acids and their derivatives to form novel acid condensation products; and that the soap salts of these condensation products can be usefully used as agents in the sizing of paper, particularly as fortifying agents for rosin acid sizes.

In order to reduce the absorbency of paper, it is necessary to incorporate a size within the pores of the paper and for this purpose the use of natural and synthetic resins has been proposed. The paper is treated with the size in solution form and the resin then precipitated within the pores of the paper. By far the most widely used paper sizes are those derived from natural gums, wood and tall oil resins (i.e. the rosin components thereof). The naturally occurring resinous acids can be used as such or they can first be condensed with maleic anhydride or they can be converted into other products by a disproportionation reaction, and then converted into a maleated resin by reaction with maleic anhydride. Thus, U.S. Pat. No. 3,390,046 describes the reaction of rosin oil with maleic anhydride to produce a modified maleated rosin oil advocated for use in paper sizing either alone or in combination with rosin acid soaps. Such rosin oil is a mixture of rosin acids and decarboxylation products thereof and is produced when rosin acids are heated, for example to induce the formation of oligomeric products. Another example of modification of the technology of rosin acid paper sizes is described in U.S. Pat. No. 2,771,464 where rosin acids are condensed with a mixture of a maleating agent and dehydrated citric acid. It is thus seen and it must be stressed, that when tall oil components have been used in this way before, it is the separated rosin acid components that have been used and not the aforesaid unsaponifiable components.

However, because the supply of rosin acids from natural sources is limited, and because the sizes prepared therefrom have not been entirely satisfactory, the use of synthetic polymeric materials has been proposed, but they have not been generally successful, except in some special applications. The use of polychlorinated paraffins has been proposed.

Snythetic anionic products have also been proposed as paper sizing agents, which products have been prepared from cracked petroleum hydrocarbons by copolymerising or condensing these unsaturated compounds with organic alpha-beta-unsaturated acids or their corresponding anhydrides under the influence of cationic or free-radical catalysts, see U.S. Pat. No. 3,532,672. However, many of these synthetic products have not proved to be efficient in paper sizing or have suffered from other disadvantages such as, for example, poor colour, poor colour stability, short shelf life or undesirable processing characteristics.

Thus the need exists for alternative sizing agents and this may be achieved by the use of my novel condensation products derived from the unsaponifiable constituents of tall oil which are substantially neutral, relatively low boiling and, above all, hitherto largely unwanted. Thus my condensation products off cost/performance characteristics which equal or better those of the natural resin paper sizes and which do not possess the disadvantages of the synthetic products hitherto made from cracked petroleum hydrocarbons. This is partly so because I have found that the condensation products of unsaponifiable tall oil components with alpha -beta-unsaturated aliphatic acids or anhydrides readily form soap salts which are highly soluble in water and which, therefore, offer advantages as paper sizing agents. Indeed, I have found that these condensation products are particularly useful as fortifying agents for rosin acid sizes because there is a synergistic effect between them which, coupled with the economic advantages possessed by my condensation products, produces a significant advance in the technology of paper sizing.

Accordingly, from one aspect, the invention provides a process for preparing novel condensation products useful in the sizing of paper, which process comprises condensing unsaponifiable constituents of tall oil with one or more alpha-beta unsaturated mono- and/or poly-basic aliphatic acids or esters or anhydrides or derivatives thereof.

From a second aspect, the present invention provides the said condensation products per se.

From other aspects the invention provides aqueous soap solutions containing alkali-metal salts of the novel condensation products; agents for use in the sizing of paper which comprises the novel products or their soap solutions; and a process for sizing paper with such a soap solution, particularly when employed as a fortifying agent for rosin acid size.

The condensation products of the invention are prepared from the unsaponifiable components of tall oil. These may be obtained, substantially free of fatty and/or rosin acids by the process described in my earlier patent. U.S. Pat. No. 3,654,255. As described in that patent, tall oil may be neutralised by reaction with an alkali-metal or ammonium base in aqueous solution and mixed with a molar excess of an alkali-metal or ammonium aryl or alkylaryl sulphonate (wherein the alkyl group or groups together contain not more than 8 carbon atoms), the resulting mixture is allowed to separate into two layers and the unsaponifiable constituents can then be separated as the upper oily layer.

Alternatively, they may be obtained from the initial, or forerun fractions which result when crude tall oil which often contains 5 – 10% but may contain up to 25% of unsaponifiable material, is distilled under reduced pressure. These fractions contain the unsaponifiable components mixed with fatty acids. The mixture normally contains 30 – 70% of each of these two types of components and the unsaponifiable components can be separated from the fatty acids by conventional solvent extraction techniques which have hitherto not been employed since the unsaponifiable components were thought to have no commercial value as a raw material.

The neutral components of tall oil are yellow to amber oils with a boiling range of 60°–160° C at 1 mm Hg. These need not be separated or refined further for use in this invention. The iodine value ranges between 250 and 350 and is a measure of the highly unsaturated nature of this predominantly hydrocarbon mixture. The acid value is substantially zero.

In the present invention the neutral unsaponifiable fraction from tall oil as defined above is condensed at temperatures between 140° and 260° C with alpha-beta unsaturated acids, their esters, nitriles or anhydrides. Suitable acids include acrylic, methacrylic, crotonic, fumaric, maleic and itaconic acid. Citric acid, which is capable of yielding a reactive unsaturated acid on heating, may also be used, as also can dehydrated citric acid. The acids or their derivatives may be employed individually or in admixture. It is particularly preferred to use maleic anhydride or acrylic acid since these are relatively cheap and are found to condense readily with the unsaturated hydrocarbons found in the unsaponifiable tall oil fractions.

The alpha-beta unsaturated acids or their derivatives are preferably employed in an amount of from 5 to 50 parts by weight per 100 parts by weight of the unsaponifiable material. The condensation is effected at elevated temperatures and it is often convenient to operate at reflux temperatures in the presence of an inert solvent, such as toluene or xylene. The condensation is normally, though not necessarily, effected by heating the reactants together in the absence of a catalyst.

It will be clear that if a monobasic acid is employed in the condensation reaction the resultant product will be a monobasic or polybasic resinous acid according to the number of molecules of the active acid which will react with one molecule of the unsaturated hydrocarbon. Similarly, if esters of the reactive acids are employed, resinous mono- or polyesters will result. Di- and polybasic resinous acids are obtained when a dibasic acid, such as fumaric acid, is condensed with the unsaturated hydrocarbon. If a reactive anhydride, such as maleic anhydride, is employed, a resinous di-, tetra- or polyacidic resinous anhydride is obtained. Thus, paper sizes of differing characteristics can be obtained by appropriate selection of the acid reactants and condensation conditions.

When the reactive acids are used in the form of their esters, then these will usually be methyl or ethyl esters which can readily be hydrolysed after the condensation reaction.

For use as paper sizing agents, the condensation products obtained as described are converted into aqueous soap salt solutions by saponifying the resultant resinous products or by hydrolysing the corresponding esters, nitriles or anhydrides, for example with aqueous alkali such as sodium or potassium hydroxide or carbonate solutions. Aqueous solutions of about 40% solid matter content are most conveniently prepared. After the saponification or hydrolysis, the reaction mixture separates into two phases, the lower, aqueous layer representing the aqueous soap solution of the invention product, and the upper layer containing unreacted and/or unreactive hydrocarbons. The phases are separated, for example by decantation. The oily phase may be re-cycled to extract, in a further reaction stage, the reactive hydrocarbons or it may be employed for other purposes.

A modification of the invention is the treatment of a resinous acid anhydride condensation product derived, for example, by the use of maleic anhydride as the reactive acid component, with gaseous or aqueous ammonia or urea, alkylamines, such as mono- or dimethylamine, ethylamine, ethanolamines, or ethylenediamine. In this case the resultant product will be a resinous mono- or polycarboxylic acid mono/poly acid amide which can be converted into an ammonium or alkali-metal salt and used in aqueous solution for paper sizing. In this way the sizing characteristics of the products of the invention can be further modified.

For paper sizing, the paper is treated with an aqueous solution of the resinous condensation products in soap salt form, that is the form of, for example, sodium, potassium or ammonium salts. After impregnation of the paper therewith, the paper is treated with a solution of an aluminium salt, such as aluminium sulphate, and this causes precipitation of the aluminium salts of the resinous condensation products within the pores of the paper where they act as a size to reduce the absorbency of the paper.

The paper sizing materials of the invention may be used by themselves or in admixture with other synthetic or conventional rosin sizes.

The present condensation products find particular utility when used as fortifying agents for rosin acid sizes. For such purposes they may be incorporated into rosin acid sizes in amounts up to 50% by weight, whereupon they exhibit a synergistic effect. This incorporation is most easily achieved by mixing the condensation products (if desired after modification thereof to introduce amide groupings) with the rosin acids and then to convert the mixture to their respective soap salts by reaction with an appropriate alkali. Alternatively the soap salt solutions may be made separately and then mixed before use.

The invention will now be illustrated by the following Examples:-

The mixture of unsaturated hydrocarbons employed in the examples was isolated from a tall oil forerun fraction of British manufacture by the general procedure outlined in my U.S. Pat. No. 3,654,255.

The forerun fraction was stirred and heated to 95° C with a 30% aqueous sodium xylene sulphonate solution and caustic soda added until the mixture was just alkaline. 1.5 mol sodium xylene sulphonate was used for each mol of fatty acid contained in the forerun. The mixture was heated under reflux for one hour and then allowed to settle. The upper unsaturated hydrocarbon layer was separated, washed with hot water and dried.

The unsaturated hydrocarbons could also be obtained by other means such as dissolving the forerun in 50% aqueous ethyl alcohol, neutralising this mixture with caustic soda and extracting the soap solution obtained with petroleum ether (B.R. 40° – 60°)

EXAMPLE 1

A mixture of unsaturated hydrocarbons obtained from the distillation forerunnings of tall oil (600g) and toluene (100g) was refluxed at 140° C and maleic anhydride (90g) gradually introduced during 2 hours. Refluxing was continued for 24 hours, the solvent was removed by distillation, finally under a vacuum of 20 mm Hg. The temperature of the reaction product, a viscous pale amber oil, was lowered to 95° C, and water (360 ml) was added. Keeping the temperature near 95° C, 40% aqueous caustic soda was gradually added with vigorous stirring until the reaction mixture remained permanently alkaline to phenolphthalein indicator. On standing for half an hour the reaction mixture had separated into an oily upper phase (350 g) and a lower aqueous layer containing approximately 45% solids in the form of resinous di- and polycarboxylic acid sodium soaps. The isolated acids had an acid value of 206 mg KOH/g. For the sizing of paper these soaps may be used at a rate of 0.5 – 1% (active matter content) based upon the dry weight of paper pulp.

EXAMPLE 2

The hydrocarbons of Example 1 (600g) were heated to 230° C and molten maleic anhydride (150g) gradually added during 1 hour. After heating for a further one hour, no maleic anhydride could be detected in the reaction mixture by I.R. spectroscopy (wave number 680). The reaction mixture was cooled and hydrolysed as in Example 1, yielding a top layer of unreacted oil (180g) and an aqueous solution containing about 620 g of resinous acids in the form of sodium soaps. The isolated mixed acids had an acid value of 244 mg KOH/g.

EXAMPLE 3

To the unsaturated hydrocarbon mixture of Example 1 (100g), heated to 240° – 250° C, glacial acrylic acid (13g) was gradually added during 3 hours. Heating was continued for a further hour. The mixture was cooled and further worked up as in Example 1. To aid separation, 5% of ethyl alcohol was added, based on the weight of the lower aqueous phase. The resinous acids were isolated by acidifying the aqueous soap solution with mineral acid. Yield: 60g, acid value 183 mg KOH/g.

EXAMPLE 4

Tests on the sizing efficiency of the resinous condensation products alone, and in admixture with standard rosin acid soap sizes were carried out by the present inventor under the following conditions and the results obtained are shown in tabular form:

Samples of paper for the sizing tests were obtained by standard laboratory procedure using 50% bleached sulphite and 50% soda pulp. Varying amounts of the sizing agents obtained according to Examples 1 – 3 (calculated as % dry resinous condensation product/-weight of dry paper pulp) and 1.5% aluminium sulphate (based on the weight of dry pulp) were successively added to the pulp beater, care being taken that the pH of the mixture after each of the additions was adjusted to 4.5. The thus obtained pulp slurry was fed into a standard sheet making machine and converted into paper sheets of 60 – 65 g/m² by the usual procedure. The obtained sheets were finally dried for 3 minutes at 105° C.

The time necessary (in seconds) for ink penetration to reduce light reflectancy by 50% of the sheet's initial value as measured by a photometer is used to represent the degree of sizing. The higher, therefore, the time values, the better the sizing efficiency.

A sample of a commercially available fortified "Supersize" was similarly evaluated as control, (Sample A).

| Sizing agent | [a]Concentration | Sizing degree (in secs) 0.5% | 1.0% | 1.5% |
|---|---|---|---|---|
| Example 1. | | 12 | 18 | 21 |
| Example 2. | | 10 | 16 | 19 |
| Example 3. | | 15 | 19 | 23 |
| Sample A. | | 16 | 21 | 27 |

[a]Based on dry weight of pulp.

Effects of varying amounts of novel condensation products when used as fortifier in admixture with rosin acid soaps:

| | [a]Fortifier. | [a]Rosin soap | [a]Total size | Sizing index |
|---|---|---|---|---|
| Example 1. | 0.75% | 0.75% | 1.5% | 26 |
| | 0.5% | 1.0% | 1.5% | 29 |
| | 0.25% | 1.25% | 1.5% | 28 |
| Example 2. | 0.75% | 0.75% | 1.5% | 25 |
| | 0.5% | 1.0% | 1.5% | 26 |
| | 0.25% | 1.25% | 1.5% | 28 |
| Example 3. | 0.75% | 0.75% | 1.5% | 27 |
| | 0.5% | 1.0% | 1.5% | 27 |
| | 0.25% | 1.25% | 1.5% | 26 |
| Sample A. | — | — | 1.5% | 27 |

[a]Based on dry weight of pulp.

EXAMPLE 5

Example 1 was repeated. Before removing the solvent, the reaction mixture is cooled to 70° C. To one half of the mixture ethylene diamine (15 g) was gradually added with cooling. The product was then worked up and isolated as described in Example 1. The resinous acids had an AV of 115, indicating that about half the available acid groups had been converted to amide groups. Similarly, the other half of the reaction mixture was treated with gaseous ammonia in excess. Aqueous caustic soda solution was added in slight excess and uncombined ammonia removed by boiling. The isolated resinous acids had an AV of 122. Soap solutions of both products were good paper sizes.

I claim:

1. A condensation for use in the sizing of paper which consists essentially of unsaponifiable constituents of tall oil having a boiling range of 60° – 160° C at 1 mm Hg, an iodine value of 250 – 350 and an acid value of substantially zero condensed at temperatures between 140° and 260° C with one or more alpha, beta - unsaturated acids and anhydrides thereof selected from the group consisting of acrylic acid, methacrylic acid, crotonic acid, fumaric acid, maleic acid, maleic anhydride, itaconic acid, citric acid, and dehydrated citric acid.

2. A condensation product according to claim 1, wherein 100 parts by weight of unsaponifiable constituents of tall oil have been condensed with a total of from 5 – 50 parts by weight of the said acids or derivatives thereof.

3. A condensation product according to claim 1, which consists essentially of 100 parts of unsaponifiable constituents of tall oil having a boiling range of 60° – 160° C at 1 mm Hg, an iodine value of 250 – 350 and an acid value substantially zero condensed with from 5 to 50 parts by weight of maleic anhydride.

4. A condensatin product according to claim 1 subsequently modified to contain amide groups with a reagent selected from the group consisting of ammonia, urea, alkylamines and alkanolamines.

5. A condensation product according to claim 1 in the form of an aqueous soap solution.

6. Soap solutions as claimed in claim 5 which also contain a rosin acid soap.

* * * * *